United States Patent [19]

Campbell, Jr.

[11] 4,354,824

[45] Oct. 19, 1982

[54] METHOD AND DEVICE FOR REDUCING HEAT FLOW FROM A WORKPIECE TO A SKIP PIPE

[75] Inventor: Frank Campbell, Jr., Houston, Tex.

[73] Assignee: Cameron Iron Works, Inc., Houston, Tex.

[21] Appl. No.: 250,502

[22] Filed: Apr. 2, 1981

[51] Int. Cl.[3] ..... F27D 1/16; F27D 3/02

[52] U.S. Cl. ..... 432/3; 432/234

[58] Field of Search ..... 432/3, 234

[56] References Cited

U.S. PATENT DOCUMENTS

| | | | |
|---|---|---|---|
| 1,753,220 | 4/1930 | Stanbery | 432/234 |
| 2,295,474 | 9/1942 | Horn | 432/234 |
| 2,482,878 | 9/1949 | Schmidt | 432/234 |
| 3,214,152 | 10/1965 | Molz | 432/235 |
| 3,226,101 | 12/1965 | Balaz | 432/234 |
| 3,236,507 | 2/1966 | McKie | 432/234 |
| 3,304,070 | 2/1967 | Jones | 432/234 |
| 3,367,641 | 2/1968 | Molz | 432/234 |
| 3,451,661 | 6/1969 | Barker | 432/234 |
| 3,552,729 | 1/1971 | Hepp | 432/234 |
| 3,572,662 | 3/1971 | Weaver | 432/234 |
| 3,642,261 | 2/1972 | Laws | 432/234 |
| 3,706,448 | 12/1972 | Salter | 432/234 |
| 3,881,864 | 5/1975 | Nicol | 432/234 |
| 3,946,763 | 3/1976 | Wilce | 138/149 |
| 4,015,636 | 4/1977 | Van Fossen | 138/149 |
| 4,035,141 | 7/1977 | Knaak | 432/234 |
| 4,056,350 | 11/1977 | Knaak | 432/234 |
| 4,081,237 | 3/1978 | Wright | 432/3 |
| 4,182,609 | 1/1980 | Hovis | 432/234 |
| 4,253,826 | 3/1981 | Campbell, Jr. | 432/234 |

FOREIGN PATENT DOCUMENTS

| | | | |
|---|---|---|---|
| 2505130 | 8/1976 | Fed. Rep. of Germany | 432/234 |
| 2296831 | 1/1975 | France | 432/234 |

*Primary Examiner*—John J. Camby

*Attorney, Agent, or Firm*—Fulbright & Jaworski

[57] ABSTRACT

A method and device for reducing the heat transfer in a high-temperature environment from a workpiece to an internally cooled skid pipe includes a plurality of alternating and spaced apart skids along an upper surface of the skid pipe. A reinforcement frame is secured to the remainder of the upper surface and an insulating material is placed within and around the reinforcement frame to effectively insulate the exposed part of the upper surface between the skid pipe and the work piece. The skids project from the upper surface more than the reinforced insulator to support the work piece.

9 Claims, 3 Drawing Figures

2
2

METHOD AND DEVICE FOR REDUCING HEAT FLOW FROM A WORKPIECE TO A SKIP PIPE

BACKGROUND OF THE INVENTION

In the steel industry, a basic metal workpiece often called a slab, billet or bloom, is pushed or walked through a reheat furnace thereby heating the workpiece in order to make it more malleable during the subsequent reworking procedure. In a pusher type furnace, a complex infrastructure of water-cooled vertical and cross pipes supports a series of water-cooled skid pipes over which the workpieces are pushed. The skid pipes themselves are insulated except for a metal skid or bead atop the pipe which supports the workpiece.

Conventional skid pipes have been round pipes with a skid welded on top of the pipe. A newer, superior pipe design as described and claimed in U.S. Pat. No. 4,253,826 comprises a truncated triangular pipe which can have as the workpiece support a welded bead on top or simply no additional structure whatsoever.

A problem to be solved in the reheat furnace is the reduction of cold spots on the underside of the workpiece. These cold spots can be caused by the shadow effect of the pipe which shields part of the hot furnace gases from rigorous actions of the workpiece. Cold spots can also occur as a result of heat transfer from the workpiece into the internally cooled skid pipe itself. It is the latter problem to which the present invention applies.

SUMMARY OF THE INVENTION

The present invention calls for an internally cooled pipe having an upper surface upon which a series of alternating spaced apart skids are secured. The concept of staggering a series of skids is known to those skilled in the art. These skids are adjacent to one another on top of conventional pipes. In the present invention, however, the skids are axially spaced apart from one another on each edge of the upper surface and are in turn transversely spaced apart from their counterpart skids on the opposite edge. The transversely spaced apart skids overlap one another in an axial direction so that the workpiece is always supported by at least one skid per skid pipe.

A reinforced insulator is located along the upper surface of the pipe between and among the spaced apart skids. The reinforced insulator may include a honeycomb or interlocking hexagonal matrix which can be purchased off the shelf. The matrix can be welded to the upper surface of the skid pipe. An insulator is then disposed within and around the honeycomb to effectively insulate the upper surface of the skid pipe. Hence, the heat transfer from the workpiece into the skid pipe is effectively reduced.

It is therefore an object of the present invention to provide a stronger skid pipe having an upper surface thereon for supporting a metal workpiece.

Another object of the present invention is to provide alternating skids which are spaced apart from one another transversely in order to disperse the concentration of the cold soaking effect of the skid upon the workpiece.

Yet another object of the present invention is to provide an insulator on the upper surface of the skid pipe to greatly reduce the heat transfer from the workpiece into the pipe.

Still another object of the present invention is to provide an insulator on the upper surface which will remain on the upper surface during furnace operations.

An even further object of the present invention is to provide a skid pipe whose upper surface can be insulated with a high durability insulator which can be easily applied without the use of high technology.

These and other objects of the present invention will become apparent when read in light of the drawings, specifications and claims below.

DESCRIPTION OF THE PREFERRED EMBODIMENT

Figures 1, 2, 3:
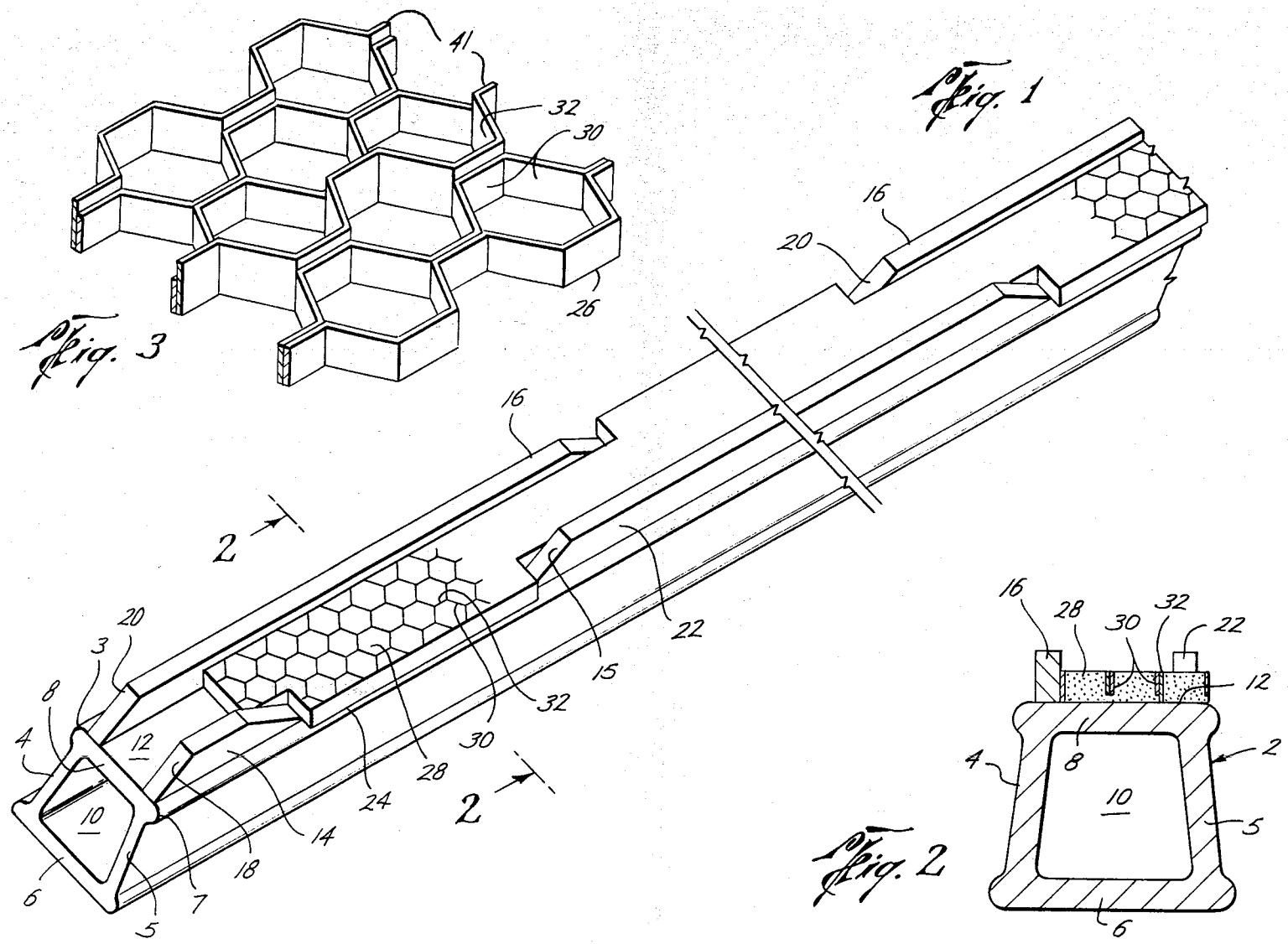
FIG. 1 is a foreshortened perspective view of the invention showing the relationship of the alternating spaced apart skids and a portion of the reinforced insulator on the upper surface of the pipe.
FIG. 2 is a cross sectional view of the invention taken along lines 2—2 of FIG. 1, further showing the differential projections of the reinforcement frame within the insulator.
FIG. 3 is an isometric view of the bottom of the reinforcement frame further showing the differential projections of the various portions of the reinforcement frame.

FIG. 1 shows a foreshortened view of the invention utilizing a new pipe design as described and claimed in U.S. Pat. No. 4,253,826. Because of the vastly improved characteristics, the truncated triangular pipe requires fewer cross pipes in the furnace than the conventional circular pipe. The truncated triangular design also works well as a skid pipe along which the workpieces are pushed.

As shown in FIG. 1, the skid pipe 2 has a base 6, a pair of converging sides 4,5 and an apex 8 connecting sides 4 and 5 at their uppermost extension. A passageway 10 is defined through which a cooling fluid, such as water, is flowed in order to keep the pipe within the desired operating temperatures inside the reheat furnace. The apex 8 has an upper surface 12 which runs the length of the pipe and is bounded transversely by opposite edges 3 and 7.

It is understood that the pipe as described thus far will effectively support the workpieces as they are pushed along the plurality of skid pipes 2. In order to reduce frictional drag, to reduce the heat transfer from the workpiece (not shown) to the skid pipe 2 and to reduce the shadow effect upon the workpiece, at least one skid 16 is secured to the edge 3 of the pipe 2. Similarly, at least one opposing skid 22 is secured to the other edge 7 of the pipe 2. As shown in FIG. 1 and FIG. 2, the skids 16 and 22 are transversely spaced apart from one another and are substantially parallel to the skid pipe axis. The skids 16 can be axially spaced apart from one another to form an alternatingly repeating pattern with one or more skids 22. Preferably, the skids 16 and 22 are alternatingly secured to the edges 3 and 7 respectively so that for a preponderance of the time the workpiece is pushed along the skid pipe 2, only one skid per skid pipe 2 contacts the workpiece. Preferably, the skids 16 and 22 are axially overlapping enough so that there is a smooth transition from one skid 16 to the other skid 22 as the workpiece is pushed along the skid pipe 2. In order to facilitate a smooth transition as the workpiece is supported by one skid 16 or the other skid 22, the leading edges 20 and 15 are sufficiently tapered to ensure that the workpiece, if it arrives low on the skid, rides up and onto the respective skid. Similarly, a short skid 14 having a leading end 18 ensures that the workpiece rides freely from the beginning on top of the skids 16 and 22 without damaging the reinforced insulator therebetween.

The reinforced insulator has a reinforcement frame 26 as shown in FIG. 3. FIG. 3 shows the reinforcement frame upside down so that the honeycomb walls 30 are clearly shown to project less than its adjacent honeycomb walls 32. In operation, the reinforcement frame 26 is situated upright or oppositely as that shown in FIG. 3 and is affixed to the upper surface 12 of the skid pipe 2. The reinforcement frame 26, in its interlocking hexagonal matrix form, only contacts the upper surface 12 along the margins 41 of the honeycomb walls 32. It is understood by those skilled in the art that the honeycomb walls 30 and 32 could be of the same width or projection, but the preferred embodiment of the present invention shows only the margins 41 contacting the upper surface 12 so that the margin 41 can be welded from place to place along the upper surface 12. As shown in FIG. 1, the geometry of the present invention is such that the reinforced pipe insulator 24 is maintained in place along the upper surface 12 by its interlocking relationship with the skids 16, 22. For additional security, however, the reinforcement frame 26 could be welded to at least one of the skids 16 or 22.

A suitable insulator 28 is located within and around the reinforcement frame 26. As shown in FIG. 2, the insulator can extend beneath the short honeycomb walls 30 to reduce further the heat transfer through the reinforcement frame 26 to the internally cooled pipe 2.

In the preferred embodiment, the reinforcement frame 26 is first secured on the upper surface 12 and between the skids 16 and 22 as shown in FIG. 1, and then a viscous, dense ceramic insulator is poured into the reinforcement frame 26 where it is permitted to set up and become a rigid ceramic insulator. The resulting reinforced insulator 24 projects upwardly from the upper surface 12 less than the skids 16 and 22 and the short skid 14 so that the workpiece does not contact the reinforced insulator.

In operation, the workpiece is supported by a skid 16 or 22 which elevates the workpiece away from the skid pipe 2 to reduce the shadow effect. The upper surface 12, which is sufficiently proximate to the workpiece to permit heat flow from the workpiece into the internally cooled skid pipe, is covered by a reinforced insulator 24 which is maintained in place, for example, by welding at least a portion of the margins 41 of the reinforced insulator 24 to the upper surface 12, by securing at least a portion of the reinforcement frame 26 to at least one of the skids 16 or 22 as well as by the interlocking geometry of the reinforced insulator 24 among the skids 16 and 22. The reinforced insulator 24 is easily applied to the upper surface 12 and can be filled with a suitable insulator 28 thereafter. When a dense ceramic insulator 28 is used to form the reinforced insulator 24, the resulting reinforced insulator is both resistant to the effects of slag dropping from the workpiece as well as providing an excellent thermal barrier between the internally cooled skid pipe 2 and the proximate workpiece.

Although a preferred embodiment has been shown and described herein, it is understood that any number of alterations, modifications, reversal of parts and other equivalent structures lie within both the spirit and the scope of the claims below.

What is claimed is:

1. A method for reducing heat transfer in a high temperature environment from a workpiece to an upper surface of an internally cooled skid pipe comprising:

(a) securing at least two transversely spaced apart skids, having leading ends, on the upper surface of said pipe, said transversely spaced apart skids alternatingly repeating themselves for substantially the length of said pipe, (b) securing a reinforcement frame to the upper surface substantially between said spaced apart skids and between the upper surface and the workpiece, (c) projecting the reinforcement frame with an insulator; and (d) projecting the reinforcement frame from the upper surface less than the skids.

2. The method of claim 1 wherein step (a) includes the axial overlapping of the alternatingly repeating spaced apart skids.

3. The method of claim 1 wherein step (b) includes the securing of at least part of the reinforcement frame to at least one of the skids.

4. The method of claim 1 wherein step (a) includes tapering the leading end of at least one skid.

5. The method of claim 1 wherein step (d) is the pouring of a viscous insulator around and within the reinforcement frame and permitting the viscous insulator to harden.

6. An internally cooled skid pipe for supporting a workpiece in a high temperature environment comprising:

(a) an upper surface in proximity to the workpiece, said surface terminating transversely in opposite edges, (b) a plurality of axially spaced apart skids on each opposite edge, said skids of one edge transversely spaced apart from the skids on the other edge and substantially axially aligned with the skid pipe, (c) a reinforcement frame secured to said upper surface and projecting from the upper surface less than the skids, (d) an insulator disposed within and around the reinforcement frame and projecting from the upper surface less than the skids, thereby covering substantially all the upper surface not covered by the skids.

7. The device of claim 6 wherein the transversely spaced apart skids are in alternating overlapping relationship in an axial direction.

8. The device of claim 6 wherein the reinforcement frame is secured to at least one of the skids.

9. The device of claim 6 wherein the reinforcement frame is an interlocking hexagonal matrix having honeycomb walls some of said walls in contact with the upper surface and the remainder of the walls spaced apart from said upper surface.

* * * * *